US006314623B1

(12) United States Patent
Wakai et al.

(10) Patent No.: US 6,314,623 B1
(45) Date of Patent: Nov. 13, 2001

(54) COIL-TYPE SLIDE FASTENER

(75) Inventors: Tatsumi Wakai; Sakae Aimono; Shinji Imai, all of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/418,798

(22) Filed: Oct. 15, 1999

(30) Foreign Application Priority Data

Oct. 30, 1998 (JP) ..... 10-309790
Jun. 29, 1999 (JP) ..... 11-183292

(51) Int. Cl.[7] ..... A44B 19/02
(52) U.S. Cl. ..... 24/403; 24/397; 24/398
(58) Field of Search ..... 24/391, 394, 397, 24/398, 403

(56) References Cited

U.S. PATENT DOCUMENTS

| | | | | |
|---|---|---|---|---|
| 3,456,306 | * | 7/1969 | Heimberger | 24/205.16 |
| 3,665,879 | | 5/1972 | Sohr . | |
| 3,783,476 | * | 1/1974 | Fröhlich | 24/205.16 |
| 3,825,977 | * | 7/1974 | Takamatsu | 24/205.1 |
| 3,854,174 | * | 12/1974 | Yoshida | 24/205.1 |
| 3,922,761 | * | 12/1975 | Schwendt | 24/205.11 |
| 4,651,389 | * | 3/1987 | Yoshida et al. | 24/433 |
| 5,010,628 | * | 4/1991 | Yamagata | 24/405 |
| 5,596,793 | * | 1/1997 | Davis | 24/394 |

FOREIGN PATENT DOCUMENTS 47-29135 1/1972 (JP) .

OTHER PUBLICATIONS

European Search Report for EP Application No. EP 99 120049 dated Nov. 27, 2000.

* cited by examiner

*Primary Examiner*—James R. Brittain
*Assistant Examiner*—Ruth C. Rodriguez
(74) *Attorney, Agent, or Firm*—Finnegan, Henderson, Farabow, Garrett & Dunner, L.L.P.

(57) ABSTRACT

A core cord is inserted into coil-shaped fastener elements made of thermoplastic resin, and the fastener elements are sewn onto a fastener tape by multi-thread chain stitch. Yarn mainly made of thermally meltable synthetic fiber is used for looper thread of multi-thread chain stitch, while yarn of fiber which is not or less meltable is used for needle thread. Entangling points of the looper thread and the needle thread are disposed on the core cord. The looper thread is thermally melted to form melted portions where the looper thread and the needle thread entangle with each other at the entangling points. As a result, melted portions which have become monofilamentary are formed on the fastener elements or no sewing yarn is on the fastener elements due to thermal melting. Thus, there is no fear of cutting of the sewing yarn due to sliding of a slider and the slide fastener is abrasive resistant. The coil-shaped fastener elements is firmly attached to the fastener tape by using such thermally meltable looper thread.

9 Claims, 6 Drawing Sheets

COIL-TYPE SLIDE FASTENER

BACKGROUND OF THE INVENTION

1. Field of the Invention

The present invention relates to a coil-type slide fastener, wherein a core cord is inserted into coil-shaped fastener elements made of thermoplastic resin, the coil-shaped fastener elements are sewn onto a longitudinal edge of a fastener tape by synthetic fiber yarn, then, the coil-shaped fastener elements are fixed to the fastener tape by thermally melting the sewing yarn of synthetic fiber.

2. Description of the Related Art

A conventional slide fastener of this type is disclosed in Japanese Patent Publication No. 47-29135, partly as shown in FIG. 12. In the Publication, a core cord 3' is inserted into coil-shaped fastener elements 1' made of thermoplastic resin, the fastener elements 1' are sewn onto a longitudinal edge of a fastener tape by multi-thread chain stitch or other sewing means by using sewing yarn of synthetic fiber, then, the sewing yarn is melted in a proper manner so that the sewing threads arranged side by side on the fastener elements 1' are welded to each other to form thick portions, or looper thread is welded to form retaining rings 8' so as to form retaining elements for needle thread 4' of the sewing yarn as shown in FIG. 12, or the looper thread is welded and fixed to shoulders of the fastener elements 1', thereby fixing the fastener elements l' to the fastener tape.

Further, as shown in FIG. 13, there is also an abrasive resistant slide fastener as disclosed in U.S. Pat. No. 5,596, 793. According to the U.S. Patent, a core cord 3" is inserted into coil-shaped fastener elements 1" made of thermoplastic resin, the fastener elements 1" are sewn onto a longitudinal edge of a fastener tape by multi-thread chain stitch means by using sewing yarn of synthetic fiber, upper looper portions of looper thread 5" are melted in a state wherein lower looper portions 5*a*" of the looper thread 5" are drawn toward the interior of the core cord 3" by applying a greater tension to needle thread 4" than to the looper thread 5" during the sewing so as to form anchor portions 8" at end portions of the lower looper portions 5*a*" on the core cord 3" such that the sewing yarn does not appear on an upper face of the fastener elements 1" fixed to the fastener tape.

In the above-described slide fastener shown in FIG. 12, the sewing yarn appearing on the upper face of the coil-shaped fastener elements 1' are welded to each other to form thick portions, or the looper thread of multi-thread chain stitch are thermally melted to form the retaining rings 8' for the needle thread 4'. Because the synthetic fiber yarn for the looper thread is merely thermally melted, thermal degradation which causes deterioration in quality of material is liable to be generated. As a result, a difference in quality of material is liable to be generated between the thick portions or retaining rings 8' formed by thermal melting and portions which were not thermally melted so that rupture is liable to take place and that the slide fastener may be broken.

In the slide fastener shown in FIG. 13, the greater tension is applied to the needle thread 4" in sewing of the coil-shaped fastener elements 1" on the fastener tape such that entangling points of the needle thread 4" with the looper thread 5" are disposed within the core cord 3" and the upper looper portions of the looper thread 5" are melted to form the anchor portions 8" at the end portions of the lower looper portions 5*a*". Therefore, when the upper looper portions of the looper thread 5" are melted while the greater tension is being applied to the needle thread 4", the lower looper portions 5*a*" are drawn deep into the core cord 3" by the needle thread 4" so that restraint strength of the core cord 3" is decreased. As a result, the lower looper portions 5*a*" may come out through a sewing hole together with the needle thread 4" when an upthrusting operation is applied to the fastener elements 1" in use. Thus, the slide fastener has a problem in its strength.

SUMMARY OF THE INVENTION

The present invention has been accomplished with the above-described problems in view. It is a main object of the invention to provide a coil-type slide fastener, wherein yarn mainly made of thermally meltable synthetic fiber is used for looper thread of multi-thread stitch for fixing coil-shaped fastener elements, and melted portions where the looper thread and needle thread entangle with each other are formed at entangling points of the looper thread and the needle thread, thereby firmly attaching and retaining the coil-shaped fastener elements to a fastener tape.

Further, it is an object of the invention to provide a coil-type slide fastener, wherein compound yarn made of synthetic fibers with different melting points is used for the looper thread, and blended yarn of non-thermally-meltable fiber and thermally meltable synthetic fiber is used for the needle thread, thereby obtaining an attaching strength of the coil-shaped fastener elements.

Furthermore, it is an object the invention to provide a coil-type slide fastener, wherein blended yarn of thermally meltable synthetic fiber and non-thermally-meltable fiber is used for each of the looper thread and the needle thread, thereby obtaining an attaching strength of the coil-shaped fastener element.

Still further, it is an object of the invention to provide a coil-type slide fastener, wherein compound yarn of synthetic fibers with different melting points is used for each of the looper thread and the needle thread, thereby obtaining an attaching strength of the coil-shaped fastener element.

Still further, it is an object the invention to provide a coil-type slide fastener, wherein blended yarn of thermally meltable synthetic fiber and non-thermally-meltable fiber is used for the looper thread, yarn of non-thermally-meltable fiber is used for the needle thread, thereby obtaining an attaching strength of the coil-shaped fastener element.

Still further, it is an object of the invention to provide a coil-type slide fastener, wherein compound yarn of synthetic fibers with different melting points is used for the looper thread, yarn of non-thermally-meltable fiber is used for the needle thread, thereby obtaining an attaching strength of the coil-shaped fastener element.

Still further, it is an object of the invention to provide a coil-type slide fastener, wherein compound yarn of synthetic fibers with different melting points is used for each of the looper thread and the needle thread, yarn made by blending the compound yarn and non-thermally-meltable fiber is used for the needle thread, thereby obtaining an attaching strength of the coil-shaped fastener element.

Still further, it is an object of the invention to provide a tough coil-type slide fastener, wherein twine of synthetic fiber is used for the core cord inserted into the coil-shaped fastener elements so that the welding of the core cord to the looper thread is facilitated, and the coil-shaped fastener elements are firmly attached to the fastener tape.

Finally, it is an object of the invention to provide a coil-type slide fastener wherein synthetic fibers of the same kinds are used for synthetic fibers used for the coil-shaped fastener elements, the core cord, the looper thread, and the needle thread, so that excellent dyeing can be applied and the fastener can be suitable to recycling.

To achieve the above objects, according to the present invention, there is provided a coil-type slide fastener including a pair of fastener stringers each having a core cord inserted into coil-shaped fastener elements made of thermoplastic resin, the coil-shaped fastener elements being sewn on an edge portion of a fastener tape of the fastener stringer by multi-thread chain stitch, wherein yarn mainly made of synthetic fiber which is thermally meltable is used for looper thread of multi-thread chain stitch, yarn mainly made of fiber which is not or less thermally meltable is used for needle thread multi-thread chain stitch, entangling points of the looper thread and the needle thread are disposed on a surface of the core cord inserted in the fastener elements, and synthetic fiber used for the looper thread or the needle thread is thermally melted to form melted portions where the looper thread and the needle thread entangle with each other at the entangling points.

Further, according to the present invention, compound yarn made by mixing synthetic fiber having a low thermal melting point with synthetic fiber having a high thermal melting point is used for the looper thread of multi-thread chain stitch, blended yarn of fiber which is not thermally meltable and synthetic fiber which is thermally meltable is used for the needle thread of multi-thread chain stitch, and the synthetic fiber used for the looper thread is thermally melted to form the melted portions at the entangling points of the looper thread and the needle thread.

Furthermore, according to the present invention, blended yarn of synthetic fiber which is thermally meltable and fiber which is not thermally meltable is used for the looper thread of multi-thread chain stitch, the same kind of blended yarn is used for the needle thread of multi-thread chain stitch, and the synthetic fiber used for the looper thread is thermally melted to form the melted portions at the entangling points of the looper thread and the needle thread.

Still further, according to the present invention, compound yarn made by mixing synthetic fiber having a low thermal melting point with synthetic fiber having a high thermal melting point is used for the looper thread of multi-thread chain stitch, the same kind of compound yarn is used for the needle thread of multi-thread chain stitch, and the synthetic fiber used for the looper thread is thermally melted to form the melted portions at the entangling points of the looper thread and the needle thread.

Still further, according to the present invention, blended yarn of synthetic fiber which is thermally meltable and fiber which is not thermally meltable is used for the looper thread of multi-thread chain stitch, yarn of fiber which is not thermally meltable is used for the needle thread of multi-thread chain stitch, and the synthetic fiber used for the looper thread is thermally melted to form the melted portions at the entangling points of the looper thread and the needle thread.

Still further, according to the present invention, compound yarn formed by mixing synthetic fiber having a low thermal melting point with synthetic fiber having a high thermal melting point is used for the looper thread of multi-thread chain stitch, yarn of fiber which is not thermally meltable is used for the needle thread of multi-thread chain stitch, the synthetic fiber used for the looper thread is thermally melted to form the melted portions at the entangling points of the looper thread and the needle thread.

Still further, according to the present invention, compound yarn made by mixing synthetic fiber having a low thermal melting point and synthetic fiber having a high thermal melting point is used for the looper thread of multi-thread chain stitch, yarn made by blending the same compound yarn with fiber which is not thermally meltable is used for the needle thread of multi-thread chain stitch, and the both synthetic fibers at the entangling points of the looper thread and the needle thread are thermally melted to form the melted portions where the melted fibers are mixed with each other at the entangling points.

Still further, according to the present invention, the core cord formed of twine of multifilament of synthetic fiber is inserted into the coil-shaped fastener elements, and the melted portions are formed at the entangling points of the looper thread and the needle thread on the core cord.

Still further, according to the present invention, synthetic fibers of the same kinds are used for synthetic fibers used for the coil-shaped fastener elements of the coil-type slide fastener, the core cord, the looper thread, and the needle thread to form the fastener stringer.

DESCRIPTION OF THE PREFERRED EMBODIMENTS

Embodiments of a coil-type slide fastener of the present invention will be described in detail below by reference to the drawings.

Figure 1:
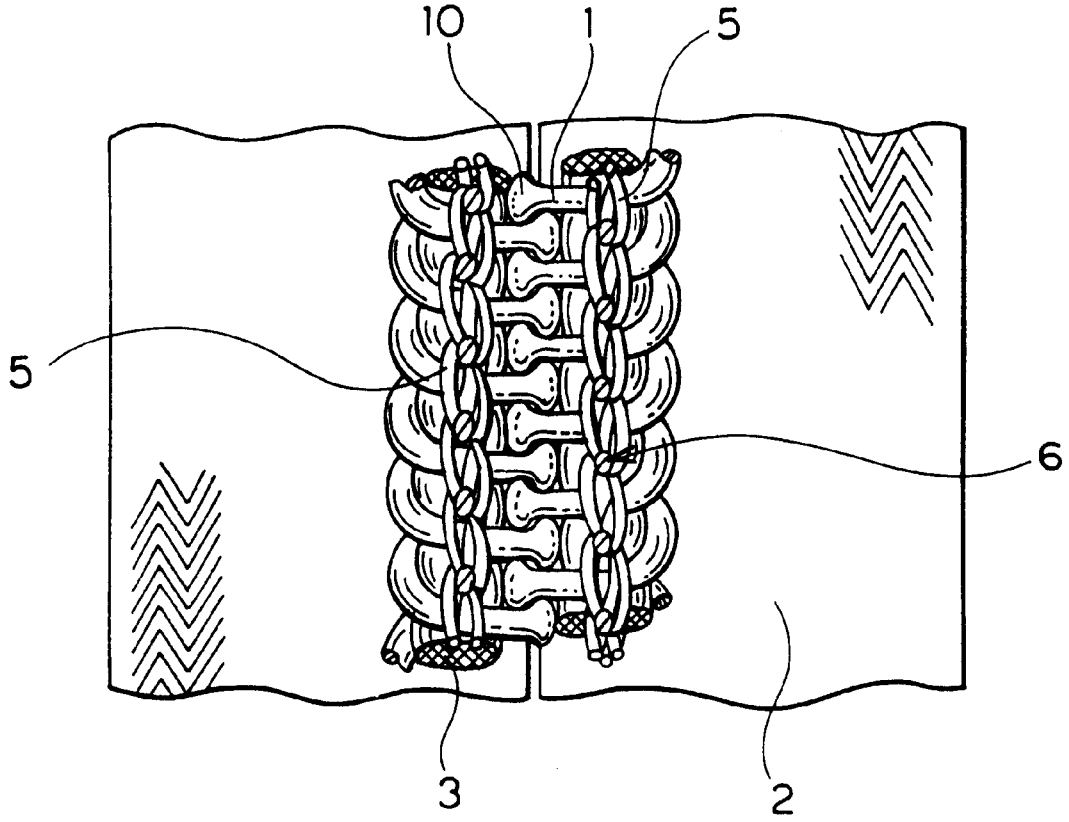
FIG. 1 is a front view of a coil-type slide fastener chain before melting processing.
Figure 2:
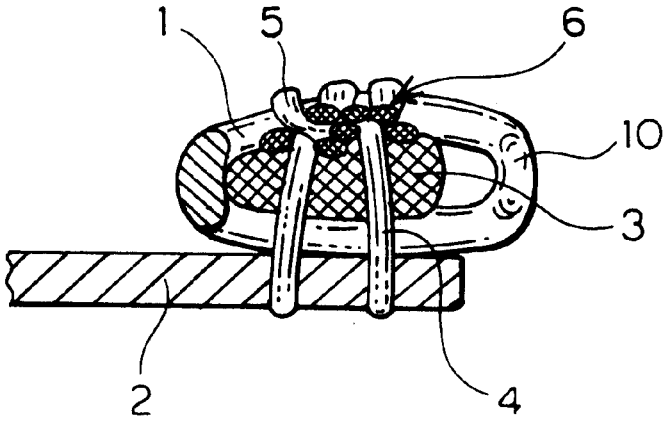
FIG. 2 is a cross-sectional view of a coil-type slide fastener stringer of the slide fastener chain in FIG. 1.
Figure 3:
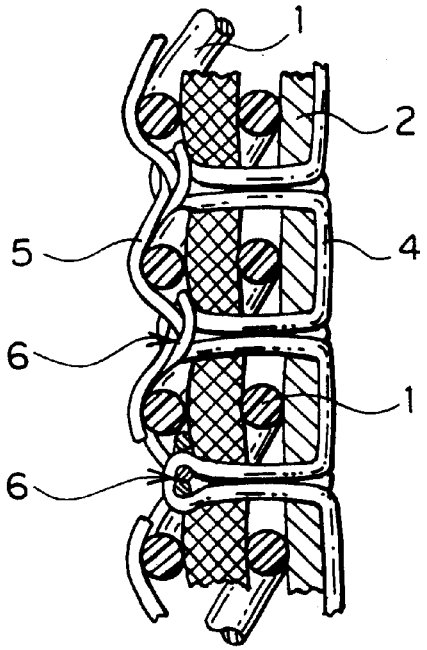
FIG. 3 is a vertical sectional view of the coil-type slide fastener stringer.

The coil-type slide fastener of the invention is formed by winding a monofilament of synthetic fiber such as polyamide, polyester, or the like into a coil shape as coil-shaped fastener elements 1, forming coupling heads 10, inserting a core cord 3 made of twine of multifilament of synthetic fiber such as polyamide, polyester, or the like into the coil-shaped fastener elements 1, and sewing the coil-shaped fastener elements 1 onto a longitudinal edge of a fastener tape 2 by using sewing yarn of proper quality of material, as shown in FIGS. 1 to 3.

For a sewing means, looper thread 5 of multi-thread chain stitch by one needle and two threads is disposed as upper yarn disposed on an upper side of the coil-shaped fastener elements 1, and needle thread 4 of multi-thread chain stitch is disposed as lower yarn disposed on a back side of the fastener tape 2. Depending on a size of the coil-shaped fastener elements 1, the coil-shaped fastener elements 1 may be sewn onto the fastener tape 2 by arranging two side-by-side lines of multi-thread chain stitches of one needle and two threads or by multi-thread chain stitch by two needles and three threads.

According to the invention, the coil-type slide fastener formed in the above manner is characterized in that yarn mainly made of thermally meltable synthetic fiber is used for the sewing yarn for attaching the coil-shaped fastener elements 1 to the fastener tape 2, i.e., the looper thread 5 by multi-thread chain stitch, yarn made of less meltable fiber is used for the needle thread 4, entangling points 6 where the looper thread 5 and the needle thread 4 entangle with each other are positioned on a surface of the core cord 3 inserted into the coil-shaped fastener elements 1, and the synthetic fiber used for the looper thread 5 is thermally melted to form melted portions 8 where the looper thread 5 and the needle thread 4 entangle with each other at the entangling points 6.

Next, the coil-type slide fastener of the invention will be specifically described by way of some embodiments of the coil-type slide fastener.

Figure 4:
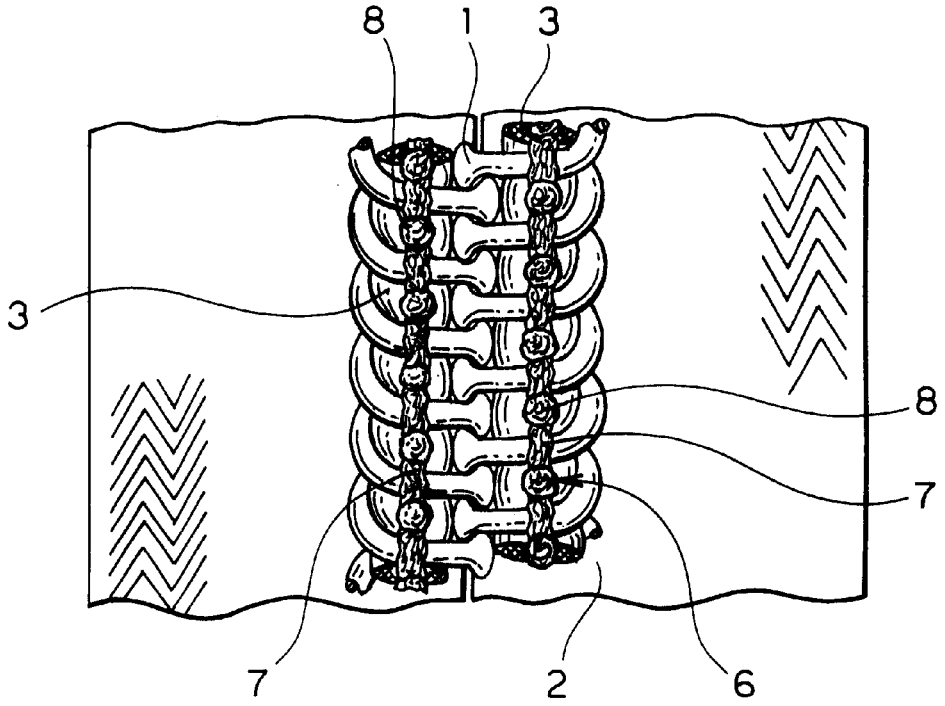
FIG. 4 is a front view of the coil-type slide fastener chain after melting processing.
Figure 5:
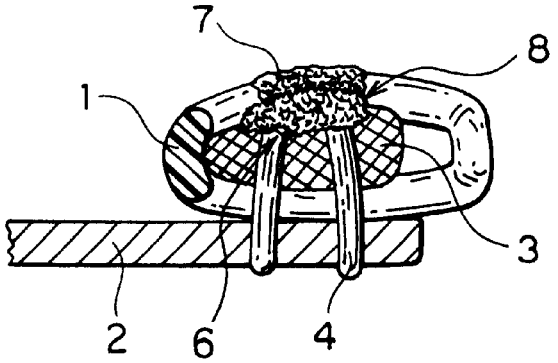
FIG. 5 is a cross-sectional view of the coil-type slide fastener stringer of the slide fastener chain in FIG. 4.
Figure 6:
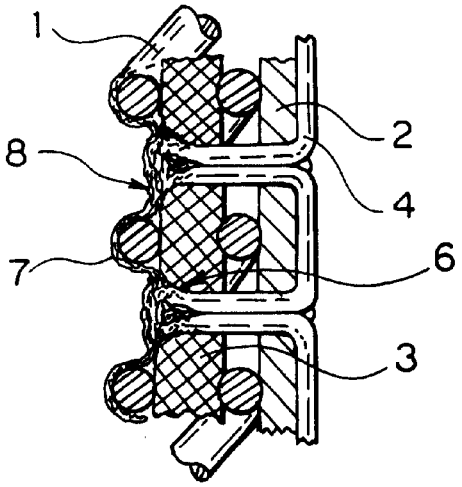
FIG. 6 is a vertical sectional view of the coil-type slide fastener stringer.

FIGS. 4 to 6 show a coil-type slide fastener according to a first embodiment of the invention. Looper thread 5,which is to be sewn by multi-thread chain stitch, is formed of compound yarn made by mixing synthetic fiber having a low thermal melting point such as polyamide 6 fiber, with synthetic fiber having a high thermal melting point such as polyamide 66 fiber. Needle thread 4 is formed of blended yarn of non-thermally-meltable fiber such as natural fiber and thermally meltable synthetic resin such as polyamide 66 fiber or polyester fiber. When the looper thread 5 is heated by a hot air blower, a heating irradiator of infrared rays, laser beam, or the like, a thermally setting device, for finishing processing, or the like to melt the polyamide 6 fiber having the low thermal melting point, melted fiber penetrates in between the polyamide 66 fibers on a surface of the coil-shaped fastener elements 1 so that the fibers become monofilament. At the same time, melted portions where the polyamide 66 fiber of the looper thread 5, the natural fiber and polyamide 66 fiber of the needle thread 4 entangle with each other are formed at entangling points to form enlarged melted portions 8 on the core cord 3, thereby firmly fixing the coil-shaped fastener element 1 to the fastener tape 2. Furthermore, because there is the sewing yarn which has become monofilament on the surface of the coil-shaped fastener elements 1, an abrasive resistant fastener stringer wherein the sewing yarn is prevented from being cut due to sliding of a slider can be completed.

The synthetic fiber which are thermally meltable does not have to be melted completely and may be melted partially to such an extent that the enlarged portions are formed as a result of melting as described above.

According to a second embodiment of the present invention, compound yarn made of denatured polyester fiber as the synthetic fiber having a low thermal melting point with polyester fiber as the synthetic fiber having a high thermal melting point is used for the looper thread 5 of multi-thread chain stitch, blended yarn of natural fiber and polyester fiber is used for the needle thread 4. Heating processing is applied, fibers of the looper thread 5 itself are welded to each other so that melted portions 7 are formed on the coil-shaped fastener elements 1 by the welding, and enlarged melted portions 8 where the fibers entangle with each other are formed at entangling points 6 of the looper thread 5 and theneedle thread 4. Thus, an abrasive resistant fastener stringer according to this embodiment is finished.

Figure 7:
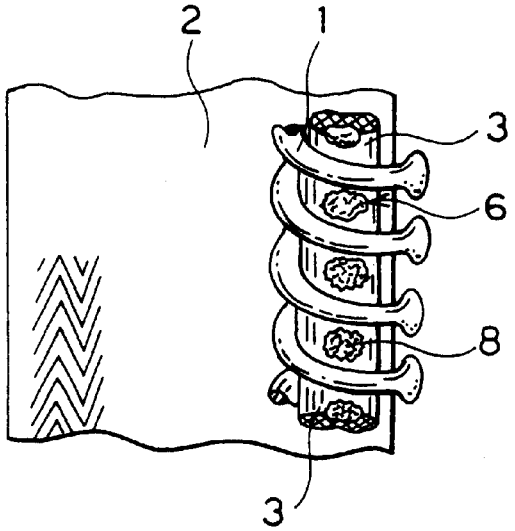
FIG. 7 is a front view of the coil-type slide fastener chain further processed with melting.
Figure 8:
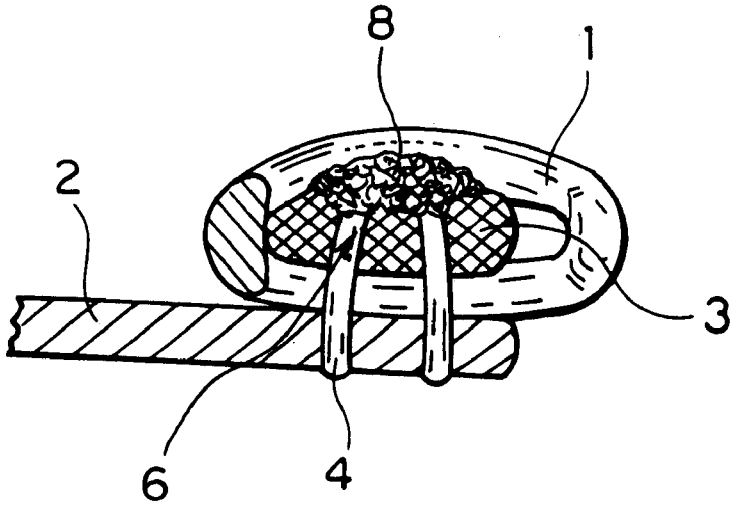
FIG. 8 is a cross-sectional view of the coil-type slide fastener stringer of the slide fastener chain in FIG. 7.
Figure 9:
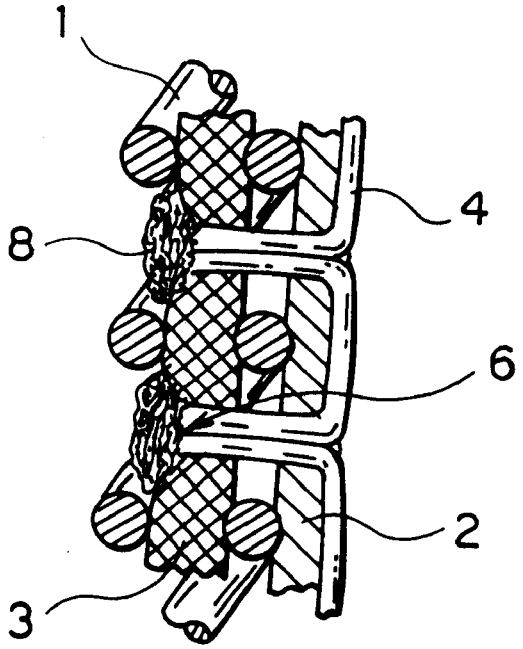
FIG. 9 is a vertical sectional view of the coil-type slide fastener stringer.

In the above first and second embodiments, when the compound yarned used for the looper thread 5 and formed of the synthetic fiber having the low thermal melting point and the synthetic fiber with the high thermal melting point, e.g., polyamide 6 fiber and polyamide 66 fiber, or denatured polyester fiber and polyester fibers, is heated such that both the synthetic fibers are melted, the looper thread 5 of the compound yarn disposed on the surface of the coil-shaped fastener elements 1 is melted and accumulated entirely to the entangling points 6 of the looper thread 5 with the needle thread 4. The fibers thus accumulated and melted in the above manner entangle with the needle thread 4 to form the enlarged melted portions 8 on the core cord 3 as shown in FIGS. 7 to 9, thereby finishing a fastener stringer wherein the melted portions 8 are prevented from being broken and coming out of the sewing holes even if upthrusting force acts on the coil-shaped fastener elements 1 and the coil-shaped fastener elements 1 are fixed firmly. Because there is no sewing yarn on the surface of the coil-shaped fastener elements 1 in the fastener stringer of this type, the sewing yarn is not damaged by sliding of the slider, thus the tough and abrasion resistant fastener stringer can be obtained.

According to a third embodiment of the present invention, blended yarn formed by blending thermally meltable synthetic fiber such as polyamide 6 fiber and non-thermally-meltable fiber such as natural fiber is used for looper thread 5 of multi-thread chain stitch, the same kind of blended yarn as the looper thread 5 is used for the needle thread 4. The synthetic fiber such as polyamide 6 fiber which is used for the looper thread 5 and which can be thermally melted is heated and thermally melted to form enlarged melted portions 8 at entangling points 6 of the looper thread 5 and the needle thread 4, and the melted fiber penetrates in the natural fibers of the looper thread 5 on the surface of the coil-shaped fastener elements 1 so as to reinforce the natural fibers as shown in FIGS. 4 to 6, thereby obtaining a fastener stringer which is abrasive resistant to sliding of a slider. As the thermally meltable synthetic fiber, synthetic fiber such as polyamide 66 fiber, denatured polyester fiber, polyester fiber, and the like can be used.

As a fourth embodiment of the present invention, compound yarn made by mixing synthetic fiber having a low thermal melting point such as polyamide 6 fiber with synthetic fiber having the high thermal melting point such as polyamide 66 fiber is used for looper thread 5 of multi-thread chain stitch, and the same kind of compound yarn as the looper thread 5 is used for needle thread 4. The synthetic fiber having a low thermal melting point such as polyamide 6 fiber used for the looper thread 5 is heated and thermally melted to form enlarged melted portions 8 at entangling points 6 of the looper thread 5 with the needle thread 4, and melted portions 7 in which melted fiber penetrates in the synthetic fiber with the high thermal melting point such as polyamide 66 fiber remain on the surface of the coil-shaped fastener elements 1, as shown in FIGS. 4 to 6. Thus, an abrasive resistant fastener stringer according to this embodiment can be obtained. As the thermally meltable synthetic fiber, synthetic fiber such as polyamide 66 fiber, denatured polyester fiber, polyester fiber, or the like is preferable.

In the above embodiment, if the compound yarn used for the looper thread 5 and formed of the synthetic fiber having a low thermal melting point such as the above-described polyamide 6 fiber and the synthetic fiber having a high thermal melting point such as polyamide 66 fiber, or denatured polyester fiber and polyester fiber, is heated such that both the synthetic fibers are melted, the looper thread 5 of the compound yarn disposed on the surface of the coil-shaped fastener element 1 is melted and accumulated entirely to the entangling points 6 of the looper thread 5 with the needle thread 4, and the melted fibers entangle with the needle thread 4 to form the enlarged melted portions 8 on the core cord 3, thereby obtaining a tough and abrasive resistant fastener stringer wherein there is no sewing yarn on the surface of the coil-shaped fastener elements 1, as shown in FIGS. 7 to 9.

As a fifth embodiment of the present invention, blended yarn made by blending thermally meltable synthetic fiber such as polyamide 6 fiber and non-thermally-meltable synthetic fiber such as natural fiber is used for looper thread 5 of multi-thread chain stitch, and non-thermally-meltable fiber such as natural fiber is used for needle thread 4. The synthetic fiber which is used for the looper thread 5 and which can be thermally melted, i.e., the above polyamide 6 fiber is heated and thermally melted, enlarged melted portions 8 where the natural fiber entangle with the polyamide 6 fiber are formed at entangling points 6 of the looper thread 5 with the needle thread 4, and melted portions 7 where melted fiber penetrates in the natural fiber on the surface of the coil-shaped fastener element 1 are formed, so that the looper thread 5 of the natural fiber is reinforced, as shown in FIGS. 4 to 6. Thus, an abrasive resistant fastener stringer according to this embodiment can be obtained. As the thermally meltable fiber, synthetic fiber such as polyamide 66 fiber, denatured polyester fiber, and other polyester fiber can be used.

As a sixth embodiment of the present embodiment, compound yarn made by mixing synthetic fiber having a low thermal melting point such as polyamide 6 fiber with synthetic fiber having a high thermal melting point such as polyamide 66 fiber is used for looper thread 5 of multi-thread chain stitch, and non-thermally meltable fiber such as natural fiber is used for needle thread 4. The synthetic fiber having a low thermal melting point such as the above polyamide 6 fiber used for the looper thread 5 is heated and thermally melted, and enlarged melted portions 8 where the natural fiber entangles with the polyamide 6 fiber are formed at entangling points 6 of the looper thread 5 with the needle thread 4, so that melted portions 7 where melted fiber penetrates in the fiber having a high thermal melting point such as polyamide 66 fiber are formed on the surface of the coil-shaped fastener elements 1, and remaining looper thread 5 is reinforced, as shown in FIGS. 4 to 6. Thus, an abrasive resistant fastener stringer according to this embodiment can be obtained. Denatured polyester fiber can be used as the synthetic fiber having a low thermal melting point and polyester fiber or the like can be used as the synthetic fiber having a high thermal melting point.

When the compound yarn of the synthetic fiber having a low thermal melting point such as polyamide 6 fiber and the synthetic fiber having a high thermal melting point such as polyamide 66 fiber is heated such that both the fibers are melted, the looper thread 5 of the compound yarn disposed on the surface of the coil-shaped fastener elements 1 is melted and accumulated entirely to the entangling points 6 of the looper thread 5 with the needle thread 4, so that the melted fiber and the natural fiber of the needle thread 4 entangle with each other to form enlarged melted portions 8 on the core cord 3. As a result, a tough and abrasive resistant fastener stringer is finished, where no sewing yarn is disposed on the surface of the coil-shaped fastener elements 1, as shown in FIGS. 7 to 9.

Figure 10:
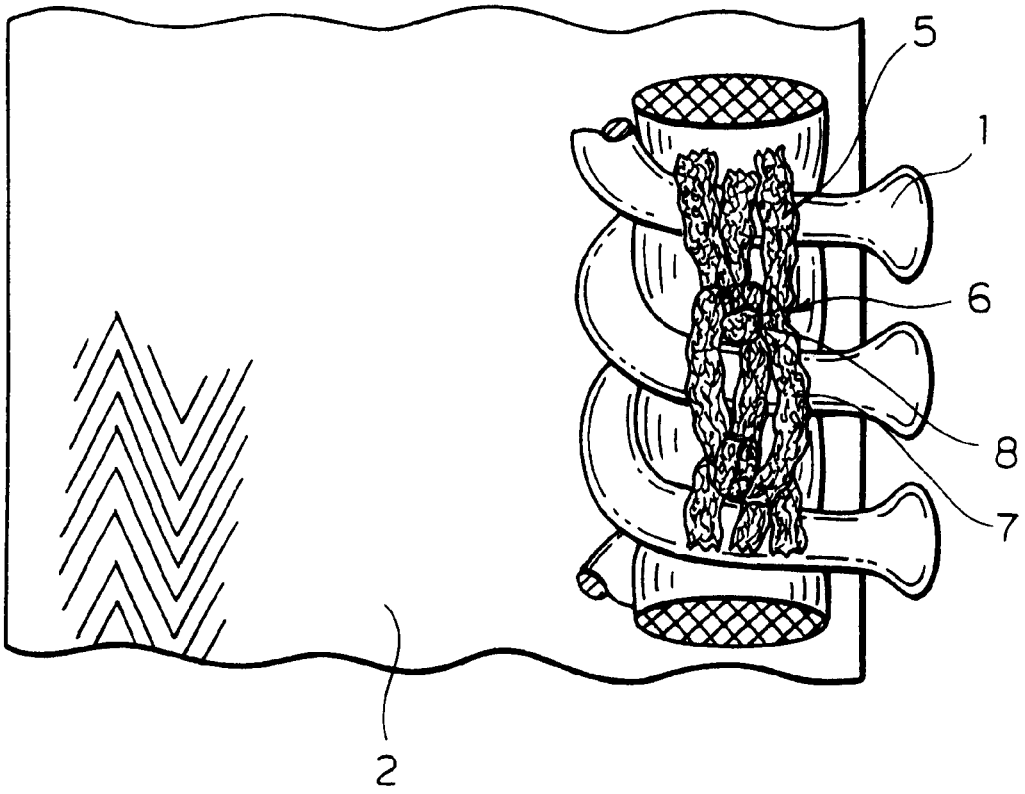
FIG. 10 is a front view of the coil-shaped fastener stringer processed with melting.
Figure 11:
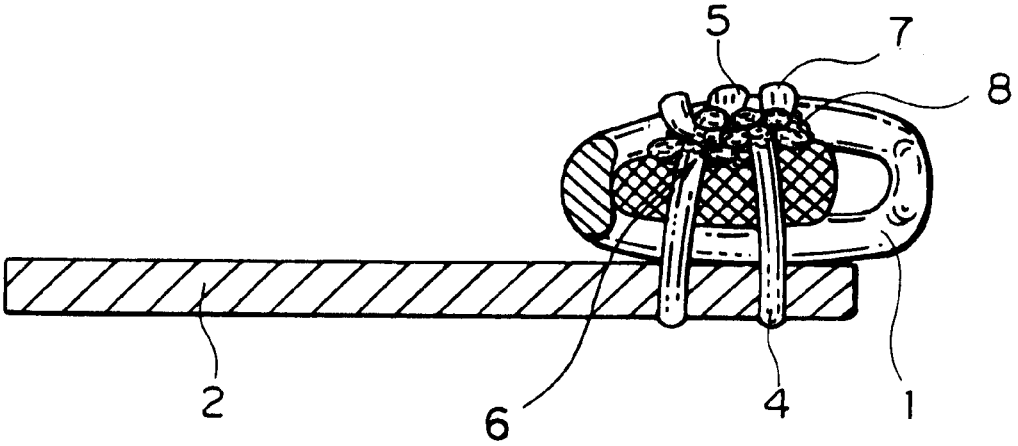
FIG. 11 is a cross-sectional view of the coil-shaped fastener stringer.
Figure 12:
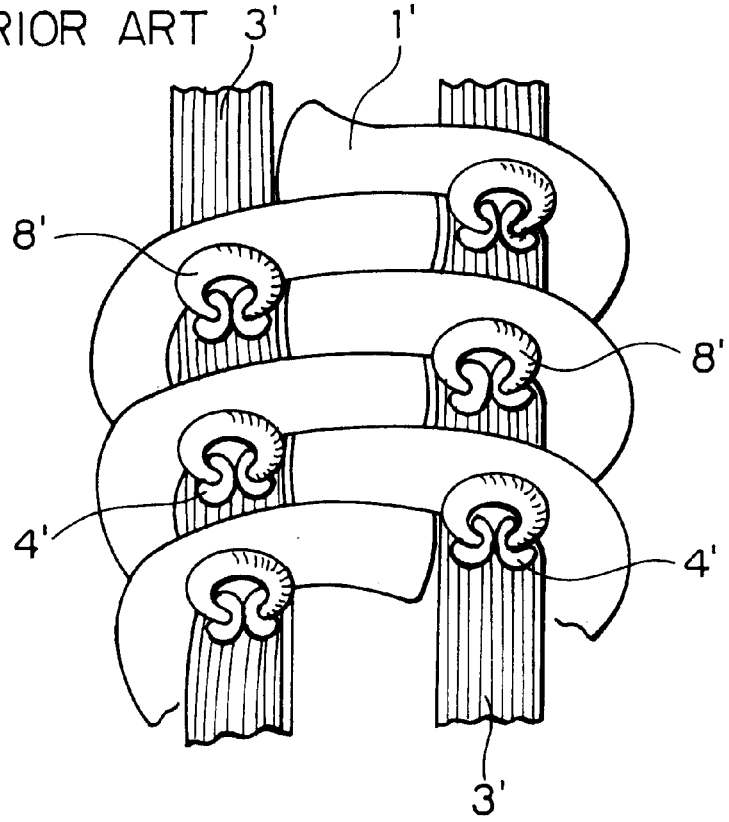
FIG. 12 PRIOR ART
FIG. 12 is a front view of a known coil-type slide fastener chain.
Figure 13:
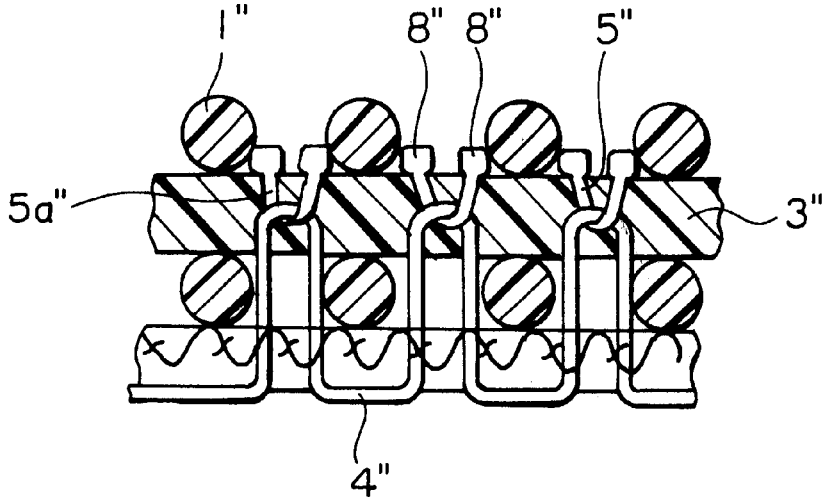
FIG. 13 PRIOR ART
FIG. 13 is a vertical sectional view of another known coil-type slide fastener stringer.

Although the melted portions 8 formed at the entangling points 6 of the looper thread 5 with the needle thread 4 described in the above respective embodiments are enlarged, in a seventh embodiment shown in FIGS. 10 and 11, fiber of the looper thread 5 a part of which is melted by heating is melted and hardened in a state wherein the fiber adheres to a part of fiber of the needle thread 4 or the looper thread 5 entangling with each other at the entangling points 6 to form melted portions 8. Furthermore, blended yarn made by blending thermally meltable synthetic fiber and non-thermally-meltable synthetic fiber is used for both the looper thread 5 and the needle thread 4, or compound yarn formed by mixing synthetic fiber having a low thermal melting point with synthetic fiber having a high thermal melting point is used for the looper thread 5, and yarn formed by blending the compound yarn and non-thermally meltable fiber is used for the needle thread 4, the synthetic fibers of both the looper thread 5 and the needle thread 4 are melted at the entangling points 6 to form the melted portions 8 where melted synthetic fibers are mixed and hardened. Even if excessive heat is applied to the needle thread 4 in a manufacturing step, it is impossible that the entire needle thread 4 is melted to reduce strength of yarn or that the yarn disappears, thereby maintaining attaching strength of the fastener elements 1.

As the synthetic fiber used for the coil-type slide fastener of the invention, not only the above-described kinds of synthetic fibers but also other synthetic fibers can be used. Further, compound yarn made by mixing various kinds of synthetic fibers and blended yarn made by blending natural fiber and various kinds of synthetic fibers can be used.

Finally, an eighth embodiment of the coil-type slide fastener according to the invention will be described. Synthetic fibers of the same kinds such as polyamide synthetic fibers or polyester synthetic fibers as synthetic fibers are used for coil-shaped fastener elements 1, a core cord 3 inserted and interposed into the coil-shaped fastener elements 1, looper thread 5 and needle thread 4 of multi-thread chain stitch for sewing the coil-shaped fastener elements 1 and the core cord 3 on the fastener tape 2, which constitute the coil-type slide fastener. As a result, a coil-type slide fastener which is suitable for excellent dyeing processing or recycling can be obtained.

The coil-type slide fastener according to the invention has the above-described structure and exhibits the following effects by that structure.

According to the present invention, in a fastener stringer having a core cord 3 inserted into coil-shaped fastener elements 1 made of thermoplastic resin and sewn on an edge portion of a fastener tape 2 of the fastener stringer by multi-thread chain stitch, yarn mainly made of synthetic fiber which is thermally meltable is used for looper thread 5, yarn mainly made of fiber which is not or less thermally meltable is used for needle thread 4, entangling points 6 of the looper thread 5 and the needle thread 4 are disposed on a surface of the core cord 3, and synthetic fiber used for the looper thread 5 or the needle thread 4 is thermally melted to form melted portions 8 where the looper thread 5 and the needle thread 4 entangle with each other at the entangling points 6.

With this structure, the looper thread 5 for attaching the coil-shaped fastener elements 1 is mainly made of the thermally meltable synthetic fiber and the looper thread 5 is thermally melted to form the melted portions 8 at the points where the looper thread 5 and the needle thread 4 entangle with each other on the core cord 3. As a result, the coil-shaped fastener elements 1 can be firmly attached so that a tough coil-type slide fastener which is abrasive resistant to sliding of the slider can be finished.

Further, according to the present invention, the compound yarn or the blended yarn made by using thermally meltable synthetic fiber is used for the looper thread 5, and the natural fiber, the blended yarn or the compound yarn of thermally meltable synthetic fiber is used for the needle thread 4. As a result, it is easy to dispose the melted portions 8 at the entangling points 6 of the looper thread 5 and the needle thread 4 by thermally melted fiber. By combinations of the looper thread 5 and the needle thread 4 of the different types of fibers, the coil-shaped fastener elements 1 are firmly attached so that a tough coil-type slide fastener can be finished.

Furthermore, according to the present invention, the core cord 3 made of twine of multifilament of synthetic fiber is inserted into the coil-shaped fastener elements 1 and the melted portions 8 are formed at the entangling points 6 of the looper thread 5 and the needle thread 4 on the core cord 3. As a result, because the core cord 3 is the twine of the synthetic fiber, the melted portions 8 made by thermally melting the looper thread 5 can be easily welded to the core cord 3, so that attaching strength of the coil-shaped fastener elements 1 can be increased.

Still further, according to the present invention, the synthetic fibers of the same kinds are used for the synthetic fibers used for the coil-shaped fastener elements 1, the core cord 3, the looper thread 5, and the needle thread 4 to form the fastener stringer. As a result, a coil-type slide fastener which can be easily applied with excellent dyeing and which is suitable to recycling, can be obtained. As described above, the effects exhibited by the invention are extremely remarkable.

What is claimed:

1. A coil-type slide fastener including a pair of fastener stringers each having a core cord inserted into coil-shaped fastener elements made of thermoplastic resin, said coil-shaped fastener elements being sewn on an edge portion of a fastener tape of the fastener stringer by multi-thread chain stitch comprised of looper thread and needle thread, wherein compound yam made by compounding synthetic fiber having a low melting point and synthetic fiber having a high melting point is mainly used for said looper thread, entangling points of said looper thread and said needle thread are disposed on a surface of said core cord, and said synthetic fiber of said looper thread that has a low melting point is thermally melted to form melted portions where said looper thread and said needle thread entangle with each other at said entangling points.

2. A coil-type slide fastener including a pair of fastener stringers each having a core cord inserted into coil-shaped fastener elements made of thermoplastic resin, said coil-shaped fastener elements being sewn on an edge portion of a fastener tape of the fastener stringer by multi-thread chain stitch comprised of looper thread and needle thread, wherein blended yarn of synthetic fiber which is thermally meltable and fiber which is not thermally meltable is used for said looper thread, entangling points of said looper thread and said needle thread are disposed on a surface of said core cord, and said synthetic fiber of said looper thread which is thermally meltable is thermally melted to form melted portions where said looper thread and said needle thread entangle with each other at said entangling points.

3. A coil-type fastener according to claim 1 or 2, wherein blended yarn made by blending fiber which is not thermally meltable and compound yarn made by compounding synthetic fiber having a low melting point and synthetic fiber having a high melting point is used for said needle thread to form said melted portions at said entangling points.

4. A coil-type slide fastener according to claim 1 or 2, wherein blended yarn of fiber which is not thermally meltable and synthetic fiber which is thermally meltable is used for said needle thread to form said melted portions at said entangling points of said looper thread and said needle thread.

5. A coil-type slide fastener according to claim 1 or 2, wherein compound yarn made by compounding synthetic fiber having a low melting point and synthetic fiber having a high melting point is used for said needle thread to form said melted portions at said entangling points of said looper thread and said needle thread.

6. A coil-type slide fastener according to claim 1 or 2, wherein yam of fiber which is not thermally meltable is used for said needle thread.

7. A coil-type slide fastener according to claim 1 or 2, wherein said core cord formed of twine of multifilament of synthetic fiber is inserted into said coil-shaped fastener elements, and said melted portions are formed at said entangling points of said looper thread and said needle thread on said core cord.

8. A coil-type slide fastener according to claim 1 or 2, wherein the material used for for said coil-shaped fastener elements, said core cord, said looper thread, and said needle thread to composing said fastener stringer are polyamide synthetic resin.

9. A coil-type slide fastener according to claims 1 or 2, wherein the material used for said coil-shaped fastener elements, said core cord, said looper thread, and said needle thread composing said fastener stringer are polyester synthetic resin.

* * * * *

UNITED STATES PATENT AND TRADEMARK OFFICE

CERTIFICATE OF CORRECTION

PATENT NO. : 6,314,623 B1
DATED : November 13, 2001
INVENTOR(S) : Wakai et al.

It is certified that error appears in the above-identified patent and that said Letters Patent is hereby corrected as shown below:

Column 9,
Line 41, “yam” should read -- yarn --.

Column 10,
Line 32, “yam” should read -- yarn --.
Line 41, “used for for said” should read -- used for said --.
Line 43, “thread to composing” should read -- thread composing --.

Signed and Sealed this

First Day of October, 2002

*Attest:*

*Attesting Officer*

JAMES E. ROGAN
*Director of the United States Patent and Trademark Office*